United States Patent [19]

Evans

[11] 4,367,699

[45] Jan. 11, 1983

[54] BOILING LIQUID ENGINE COOLING SYSTEM

[75] Inventor: John W. Evans, Sharon, Conn.

[73] Assignee: EVC Associates Limited Partnership, Moorestown, N.J.

[21] Appl. No.: 261,695

[22] Filed: May 8, 1981

Related U.S. Application Data

[63] Continuation-in-part of Ser. No. 228,714, Jan. 27, 1981, abandoned, which is a continuation-in-part of Ser. No. 157,892, Jun. 9, 1980, abandoned.

[51] Int. Cl.[3] ..... F01P 3/22

[52] U.S. Cl. ..... 123/41.23; 123/41.33; 123/41.49; 123/41.54

[58] Field of Search ..... 123/41.2, 41.21, 41.23, 123/41.25, 41.27, 41.33, 41.49, 41.54

[56] References Cited

U.S. PATENT DOCUMENTS

| | | | |
|---|---|---|---|
| 995,314 | 6/1911 | Abs | 165/73 |
| 1,323,366 | 12/1919 | Kenneweg | 123/41.25 |
| 1,329,419 | 2/1920 | Loomis | 123/41.21 |
| 1,376,086 | 4/1921 | Fairman | 123/41.14 |
| 1,424,664 | 8/1922 | Mallory | 123/41.27 |
| 1,432,518 | 10/1922 | Armstrong | 123/41.26 |
| 1,558,009 | 10/1925 | Giesler | 123/41.21 |
| 1,630,068 | 5/1927 | Muir | 123/41.2 |
| 1,630,069 | 5/1927 | Muir | 123/41.21 |
| 1,630,070 | 5/1927 | Muir | 123/41.25 |
| 1,632,583 | 6/1927 | Barlow | 123/41.26 |
| 1,649,247 | 11/1927 | Muir | 123/41.1 |
| 1,651,157 | 11/1927 | Rushmore | 123/41.24 |
| 1,658,090 | 2/1928 | Mallory | 123/41.22 |
| 1,658,933 | 2/1928 | Muir | 123/41.25 |
| 1,658,934 | 2/1928 | Muir | 123/41.25 |
| 1,687,679 | 10/1928 | Mallory | 123/41.21 |
| 1,700,270 | 1/1929 | Muir | 123/41.21 |
| 1,702,910 | 2/1929 | Mallory | 123/41.22 |
| 1,703,164 | 2/1929 | Muir | 123/41.25 |
| 1,706,693 | 3/1929 | Kenneweg | 123/41.21 |
| 1,754,300 | 4/1930 | Ayres et al. | 123/41.26 |
| 1,767,598 | 6/1930 | Mallory | 123/41.25 |
| 1,806,382 | 5/1931 | Barlow | 123/41.2 |
| 1,812,899 | 7/1931 | Pope, Jr. | 123/41.26 |
| 1,815,240 | 7/1931 | Clegg | 123/41.08 |
| 1,838,450 | 12/1931 | Pope, Jr. | 123/41.21 |
| 1,860,258 | 5/1932 | Lyon et al. | 123/41.25 |
| 1,895,509 | 1/1933 | Foutz | 123/41.26 |
| 2,240,065 | 4/1941 | Berger et al. | 123/174 |
| 2,292,946 | 8/1942 | Karig | 123/174 |
| 2,403,218 | 7/1946 | Hanners | 123/41.26 |
| 2,417,591 | 3/1947 | Levesque du Rostu | 123/41.25 |
| 2,597,450 | 5/1952 | Cline | 73/116 |
| 2,649,082 | 8/1953 | Harbert et al. | 123/41.25 |
| 2,681,643 | 6/1954 | Hull | 123/41.08 |
| 2,766,740 | 10/1950 | Tacchella | 123/41.23 |
| 2,804,860 | 9/1957 | Tacchella et al. | 123/41.21 |
| 2,825,317 | 3/1958 | Tacchella et al. | 123/41.23 |
| 2,844,129 | 7/1958 | Beck, Jr. et al. | 123/41.21 |
| 2,926,641 | 3/1960 | Tacchella et al. | 123/41.21 |
| 3,082,753 | 3/1963 | Bullard | 123/41.08 |
| 3,168,080 | 2/1965 | Latterner et al. | 123/41.08 |
| 3,223,075 | 12/1965 | Barlow | 123/41.24 |
| 3,282,333 | 11/1966 | Jensen | 123/41.27 |
| 3,286,933 | 11/1966 | Savage | 239/304 |
| 3,312,204 | 4/1967 | Barlow | 123/41.25 |
| 3,384,304 | 5/1968 | Barlow | 237/8 |
| 3,524,499 | 8/1970 | Senf | 123/41.1 |

FOREIGN PATENT DOCUMENTS

| | | |
|---|---|---|
| 753423 | 9/1952 | Fed. Rep. of Germany . |
| 973203 | 2/1951 | France . |
| 255427 | 10/1927 | United Kingdom . |
| 480461 | 2/1938 | United Kingdom . |
| 508150 | 6/1939 | United Kingdom . |

OTHER PUBLICATIONS

"Evaporative Cooling of Internal Combustion Engines", by E. J. Beck, U.S. Naval Civil Engineering Research and Evaluation Final Report, Jan. 24, 1958.

"Dual Circuit Ebullition Cooling for Automotive Engines", Society of Automotive Engineers, San Francisco, California, Aug. 17–20, 1964, by A. A. Tacchella, J. A. Fawcett and A. N. Anderson.

"Evaporative Cooling", H. C. Harrison, *The Journal of the Society of Automotive Engineers,* vol. XVIII, No. 2, (Feb. 1926).

"Dow Chemical Fills Cooling Gap", Automotive Industries, Aug. 15, 1970, pp. 53–54, by Joseph Geschelin.

"Let The Engine Boil", by Thomas E. Stimson, Jr., Popular Mechanics, vol. 91, No. 5, May 1949.

Diesel Progress North American, Jan. 1981.

*Primary Examiner*—William A. Cuchlinski, Jr.
*Attorney, Agent, or Firm*—Kenyon & Kenyon

[57] ABSTRACT

A boiling liquid coolant system for a vehicular internal combustion engine which operates at a virtually constant predetermined pressure and predetermined temperature having a condenser which assures that all vaporized coolant is condensed under all engine operating conditions by matching the rate of condensation of vaporized coolant in the condenser to the rate vaporized coolant is generated by the engine and flows to the condenser during operation of the engine. In one embodiment, an electrically-driven fan is actuated by a thermal or pressure sensitive switch in the condenser for assuring an adequate flow of ambient air across the condenser tubes during high ambient air temperature engine operating conditions, e.g., low speed, under load or stationary idle conditions of engine operation, and during the hot soak period after engine shutdown. Condensate may be returned to a gravity supply tank by either an electric or an engine-driven pump, and a non-return flow valve assures that vapor cannot flow from the separation tank of the system to the sump in the absence of the flow of liquid coolant from the sump to the separation tank. A pipe may connect the upper and lower parts of the engine cooling jacket through a pump for positive direct circulation, without heat loss, of liquid coolant in the jacket to shorten engine warm up time. Other features include a perforated inlet tube extending into a vapor separator/condenser supply tank, a U-trap in the liquid coolant supply line, a combined pressure/vaccum relief vent valve, and a passenger compartment heater and oil temperature control integral with the separation tank.

39 Claims, 12 Drawing Figures

Fig. 10.
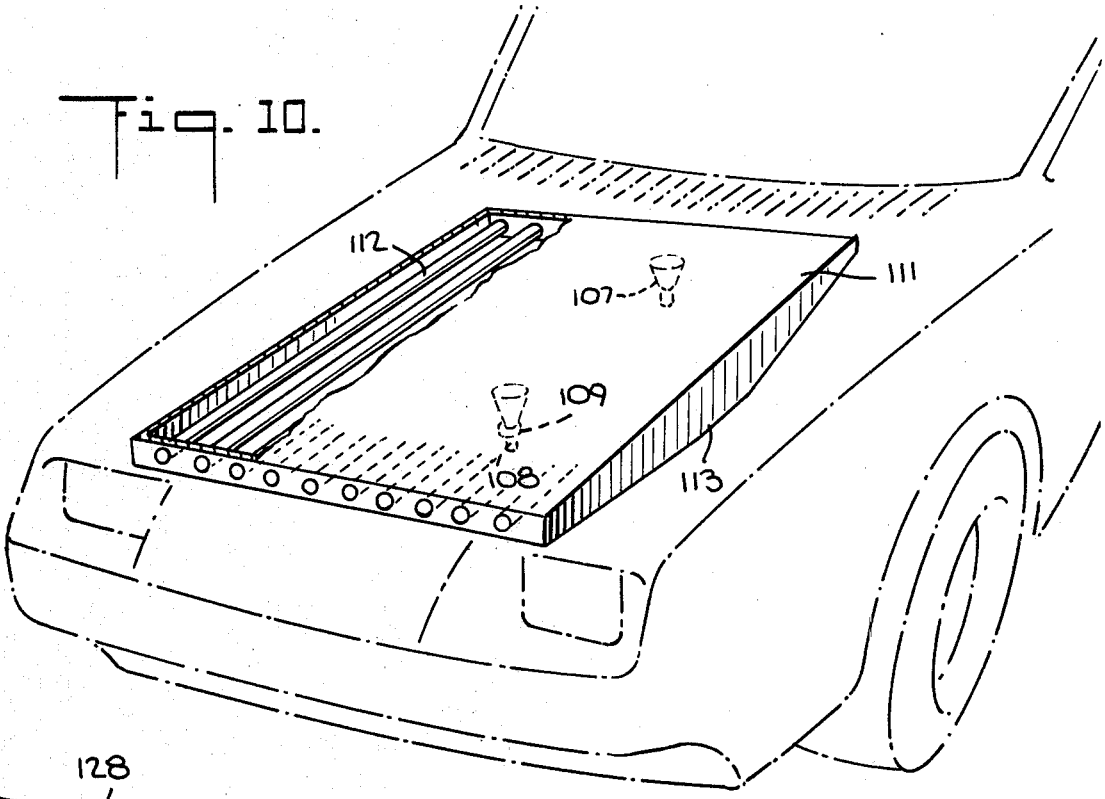
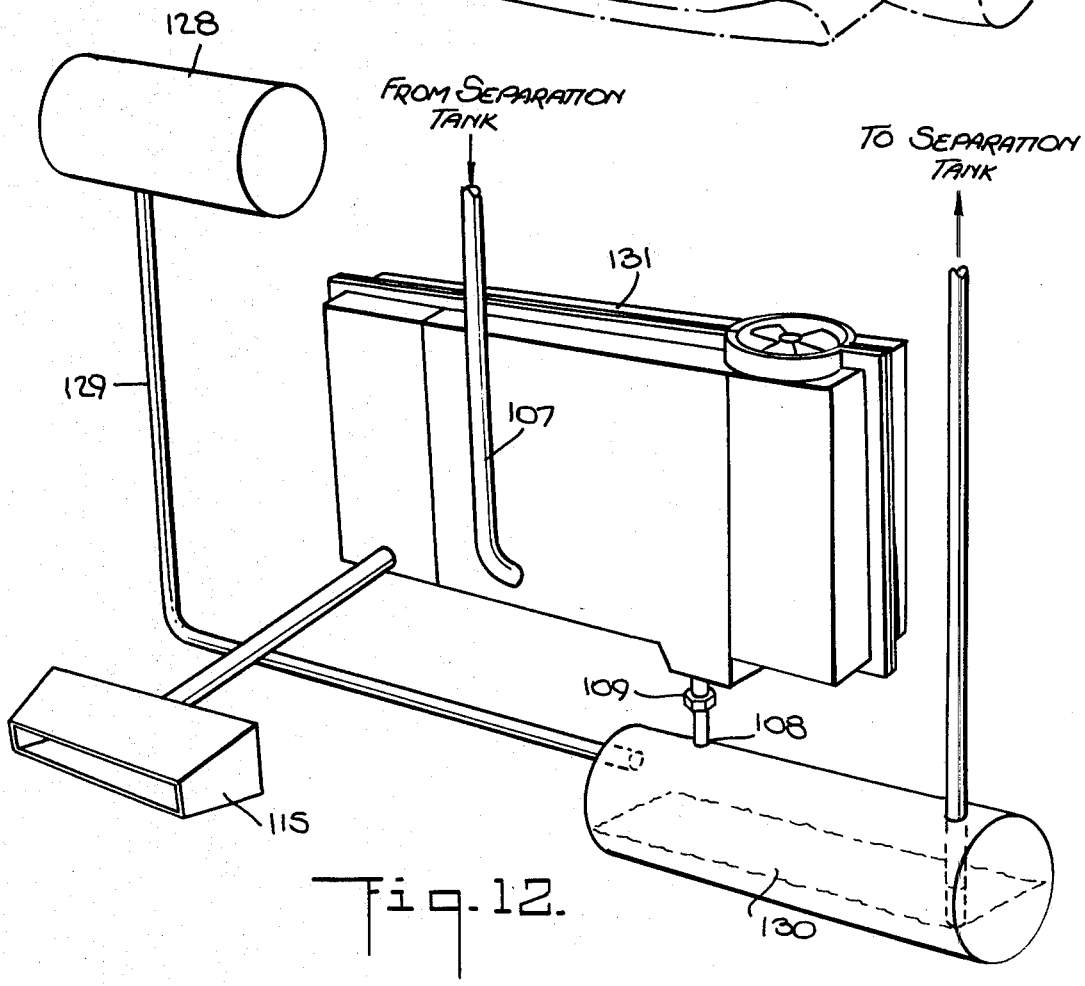
Fig. 12.

BOILING LIQUID ENGINE COOLING SYSTEM

This application is a continuation-in-part of my earlier-filed copending application Ser. No. 228,714 filed Jan. 27, 1981, now abandoned which in turn is a continuation-in-part of my earlier-filed application Ser. No. 157,892 filed June 9, 1980, now abandoned.

BACKGROUND OF THE INVENTION

1. Field of the Invention

This invention relates to cooling systems for internal combustion engines and particularly to boiling liquid coolant systems for vehicular engines.

2. Description of the Prior Art

Conventional automotive cooling systems are pressurized, forced circulation, liquid systems in which water or an aqueous antifreeze mixture is circulated by an engine-driven pump in a single closed loop circuit between the engine water jacket, where heat is transferred to the liquid coolant from the cylinders, and a radiator where the heat absorbed by the coolant in the engine is transferred to air flowing through the radiator. A pressure relief valve in the radiator fill cap is set at a pressure high enough (typically 15 psig) to prevent boiling of the liquid coolant under the normal range of engine operating conditions.

To reduce engine warm up time, a thermostatic valve is positioned at the outlet of the water jacket. The valve opens only when the coolant temperature exceeds a predetermined value (e.g. about 90° C. or higher). At coolant temperatures below the set point, no coolant can flow to or from the engine, so that the temperature of the relatively small proportion of the total system coolant that is trapped in the jacket will rise rapidly.

Although conventional pressurized single-phase liquid coolant systems are reliable and almost maintenance-free, they have several inherent drawbacks. Surface heat transfer coefficients for a fluid in the liquid phase are relatively low and vary with flow velocity. In the typical automotive cooling system, cooled liquid from the radiator enters the engine at the lower front part of the block, and heated liquid leaves from the top of the cylinder head. Consequently, the front cylinders will run cooler than the rear cylinders. In addition, it is not possible to obtain uniform velocity in the complex flow passageways inside the cooling jacket, so local hot spots develop throughout the engine. Such hot spots are believed to contribute to the production of oxides of nitrogen ($NO_x$) in the exhaust gases.

Since the highest temperatures are generated in the combustion chambers at the top of the cylinders, and since the coolant flow is generally upward through the engine, the upper part of each cylinder wall is much hotter than the lower part. This temperature differential from top to bottom of the cylinder wall (some 20° to 30° C.) causes thermal distortion of the engine block and cylinder head, with consequent increased blow-by and oil consumption. An even greater problem is that wall quenching, which produces an unburned layer of gases on the relatively cool lower cylinder walls, is the source of excessive carbon monoxide (C0) and unburned hydrocarbons (HC) in the exhaust gases. It also results in poor fuel efficiency.

The desirability of using a two phase boiling liquid cooling system to reduce the temperature differential from bottom to top of the cylinders occurring in the conventional single phase liquid system has long been recognized, and numerous proposals have been made for boiling liquid cooling systems for both stationary and mobile internal combustion engines. Representative examples of automotive boiling liquid cooling systems include U.S. Pat. Nos. 1,632,583; 3,223,075; 3,312,204; 3,384,304; 2,649,082; 1,754,300; 1,323,366; 1,812,899; 1,838,450; 2,766,740; 2,825;317; 2,804,860; 2,926,641; 1,687,679; 2,681,643; 1,860,258; 2,403,218; 1,895,509; 1,630,068; 1,630,069; 1,630,070; 1,658,933; 1,658,934; 1,703,164; 3,168,080; 3,082,753; and 3,524,499. See also, "Dual-Circuit Ebullition Cooling for Automotive Engines", a paper presented at a meeting of the Society of Automotive Engineers, San Fransisco, Calif., Aug. 17–20, 1964, by A. A. Tacchella, J. A. Fawcett and A. N. Anderson; "Evaporative Cooling", by H. C. Harrison, *The Journal of the Society of Automotive Engineers,* Vol. XVIII, No. 2 (February 1926); and "Dow Chemical Fills Cooling Gap", *Automotive Industries,* Aug. 15, 1970, pp. 53–54.

In typical boiling cooling systems, liquid coolant is boiled within the cooling jacket of the engine, the vaporized coolant being withdrawn from the upper part of the cooling jacket and flowing to an air cooled radiator or condenser, either directly or through a separator tank. The condensate collects in a sump connected to the bottom of the condenser and is returned to the inlet to the cooling jacket or to a supply tank for gravity flow to the engine.

Since boiling occurs at constant temperature (assuming the pressure is held constant) and since surface heat transfer coefficients for fluids in the vapor state are much higher than for the same fluids in the liquid state, boiling cooling systems can maintain the cylinder wall temperatures more nearly constant from top to bottom, and the entire cylinder wall will be hotter, thereby reducing the production of CO and HC in the exhaust gases and improving fuel economy.

The potential benefits of boiling liquid cooling for automotive engines are, however, difficult to achieve in a practical system. A major problem with prior automotive boiling liquid cooling systems has been the need to constantly monitor the coolant supply and to frequently replenish coolant lost through the system vent. This is not merely an inconvenience; coolant loss may be so rapid that major damage can result before the engine can be shut down.

Heretofore, it has been impossible to eliminate coolant loss from such cooling systems due to vapor loss through the system vent under all engine operating conditions. For example, it has not been possible to eliminate vapor loss during high ambient air temperature engine operating conditions which result from either a low volume of air flowing across the condenser caused, e.g., by low engine speed during idling and hill climbing or when the vehicle is moving slowly, or which is due to engine shutdown, or when outside air temperatures are very high, e.g., on a hot summer day, under which conditions the capacity of the condenser of the cooling system to condense the vaporized coolant is exceeded by the rate at which vaporized coolant is generated in the system. It has also not been possible to eliminate vapor loss under engine operating conditions during which no liquid coolant fills the return line from the sump to the separator tank, such as, for example, during engine start-up when noncondensible gases are purged from the system and coolant vapor is generated by the heat of the engine but little coolant is condensed by the condenser, during engine shutdown when high ambient air temperatures increase the amount of coolant vapor generated but the amount of condensate produced by the condenser is reduced, and during low power engine operating conditions such as, e.g., coasting down a hill when little power is utilized and the condenser also produces little coolant condensate.

Another common problem with prior vapor cooling systems is the tendency of such systems to build up excessive pressure levels as the engine load increases. A typical prior art vapor system will operate at a pressure level of 15–25 p.s.i. at moderate engine loads and at a pressure level of 25–45 p.s.i. at high engine loads if not vented. As a result, most prior art vapor cooling systems utilize a pressure relief valve of one form or another to release the excess pressure from the system. Such relief valves, however, cause a constant loss of vapor and, as a result, a continuing reduction of the amount of coolant in the system which can range from moderate to severe, depending upon the location of the relief valve. It is therefore evident that such prior art vapor cooling systems are not low pressure systems but rather are high pressure systems which use a relief valve, and do not prevent coolant loss.

A true low-pressure vapor cooling system is extremely advantageous. At sea level, a rise of approximately two degrees F. in boiling point is caused by every one pound of pressure developed by the cooling system. Therefore, if a cooling system operates under a fluctuating pressure load of, for example, 15–25 p.s.i., the resulting variation of the engine temperature will range from 30° to 50° F. in excess of its optimum operating temperature. The quick release effect of a pressure relief valve not only causes a coolant loss from the system as a result of its operation, it only partially aids in reducing the adverse effects of the vapor cooling system operating at a high pressure. The rating of a 2 p.s.i. pressure relief valve, for example, is really only an average 2 p.s.i. value since the pressure rises and falls above and below that point as the pressure at the valve builds, and then the valve releases and relieves the pressure. The shock effect of this type of relief in a vapor cooling system causes constant flashing of vapor in critical areas of the engine, particularly around the exhaust valve jacketing, the combustion chamber dome, and the exhaust port areas of the engine.

A major problem in the prior art vapor cooling systems which has gone unrecognized and causes such pressure build up is the phenomenon of vapor build-up or "back pressure" from the condenser of such systems which causes a pressure rise in the engine cooling jacket, although not in the condenser. If such a pressure rise is not checked, the result would be a vapor pocket formed at the uppermost part of the cooling jacket which as it expands in size would displace liquid coolant from the coolant jackets in the engine, eventually causing the cooling system to fail. The tubes of a condenser must, of course, be long enough so that vapor is condensed by the time it reaches the ends of the condenser tubes. However, as the length of the tubes is increased, the condenser becomes restrictive to vapor flow, which causes a back-pressure to develop as the engine produces more and more vapor, which in turn causes the formation of "hot vapor pockets" in the coolant located in the engine head and a resulting rise in the boiling temperature of the liquid coolant due to increased pressure and the engine operating temperature. This is particularly important because not only has vapor pocketed but in so doing, it has precluded liquid coolant from that space and no heat is transferred from the engine cooling jacket walls. Since under these conditions all of the vapor generated cannot flow into the condenser to be condensed into liquid, a back-up of vapor occurs at the entrance to the condenser and a continuing rise in pressure in the system also results which continues until the engine load is decreased and the volume of vapor is reduced. The condenser is, thus, a restrictive orifice and only permits the flow of a limited volume of vapor. Once the volume of vapor generated exceeds this maximum, pressure builds as vapor "backs up". The use of a pressure relief valve in prior art vapor cooling systems is not sufficient to overcome this problem and causes vapor loss.

Heretofore, the condensers in vapor cooling systems have been utilized only as heat exchangers, and not as a means for controlling the pressure level of a vapor cooling system. Various types of condensers for use in automotive cooling systems, including boiling liquid cooling systems, are disclosed in U.S. Pat. Nos. 1,329,419, 1,376,086, 1,432,518, 1,558,009, 1,658,090, 1,700,270, 1,702,910, 1,706,693, 1,767,598, 1,806,382 and 3,223,075.

As a result of the foregoing problems, prior art boiling liquid cooling systems have not been commercially utilized.

SUMMARY OF THE INVENTION

It is a principal object of the present invention, therefore, to provide an improved boiling liquid cooling system for an internal combustion engine in which the condensing capacity of the condenser of the system is effectively matched to the rate at which coolant vapor is generated by the engine during all engine operating conditions.

It is also an object of the present invention to provide an improved boiling liquid cooling system for an internal combustion engine in which a constant predetermined pressure and a constant predetermined temperature are maintained in the cooling system under all engine operating conditions.

It is also an object of the present invention to provide an improved boiling liquid cooling system for an internal combustion engine which has no coolant loss during all engine operating conditions, and in particular during high ambient air temperature engine operating conditions and during engine conditions under which there is an absence of coolant flow from the sump to the separation tank of the system.

It is a further object of the present invention to provide an improved boiling liquid cooling system for an internal combustion engine in which the system vent is totally isolated from vaporized coolant in the system under all engine operating conditions.

These and other objects of the invention are achieved in a boiling liquid cooling system for an internal combustion engine including a coolant inlet and a coolant outlet, a separation tank coupled to the inlet and outlet for separating vaporized coolant from liquid coolant, condenser means coupled to the separation tank for condensing vaporized coolant flowing from the separation tank to the condenser means during operation of the engine, sump means coupled to the condenser means for receiving condensed coolant from the condenser means, the sump means being coupled to the separation tank for returning liquid coolant to the separation tank and to the engine, and vent means for venting non-condensible gases from the cooling system during operation of the engine. The improvement comprises the condenser means including means for matching the rate of condensation of vaporized coolant in the condenser means to the rate vaporized coolant is generated by the engine and flows to the condenser means during operation of the engine, whereby a virtually constant predetermined pressure and predetermined temperature are maintained in the cooling system under all engine operating conditions. The matching means of the condenser means may comprise means for reducing the velocity and permitting the expansion of vaporized coolant as it flows into the condenser means from the separation tank.

In one embodiment of the invention, the condenser means is coupled to the separation tank by conduit means, and the matching means comprises tube means in the condenser means having a diameter which is greater than that of the conduit means, the ratio of the diameter of the tube means to the diameter of the conduit means preferably being at least 2:1. The matching means may also comprise a chamber into which vaporized coolant from the separation tank flows, the chamber being dimensioned so as to cause the vaporized coolant to immediately expand as it enters the chamber, thereby reducing the velocity and pressure of the vaporized coolant within the chamber. The condenser may further comprise elongated air-flow tubes extending through the chamber of the condenser means.

The matching means of the condenser means may include means for preventing the flow of vaporized coolant from the condenser means into the sump means during high ambient air temperature engine operating conditions, and the vent means may comprise an expansion tank into which non-condensible gases are vented from the cooling system during operation of the engine, the cooling system being closed to the atmosphere. In another embodiment of the invention, the vent means may comprise valve means, communicative with the atmosphere, for venting non-condensible gases from the cooling system to the atmosphere during operation of the engine. In addition, means for heating the oil of the engine during operation thereof may be coupled to the separation tank. The heating means may include conduit means coupled to the engine and through which oil flows during operation of the engine, the conduit means being disposed in the separation tank so as to be at least partially submerged in hot liquid coolant contained therein, thereby rapidly raising and maintaining the temperature of the oil to a predetermined engine operating temperature.

The foregoing condenser design permits the engine to operate at a virtually constant predetermined temperature and predetermined pressure and, as a result at a controlled high operating temperature without overheating. The design also greatly increases heat transfer efficiency of the condenser, thereby enabling the condenser to be reduced in size and to be located in a wide variety of places within the vehicle, since the required heat dissipation capacity of the condenser is reduced. In addition, fuel efficiency is increased and the vehicle can be designed so as to greatly reduce or eliminate frontal air intake, thereby making it possible to use a more aerodynamically efficient body design in the vehicle.

These and other objects of the invention are also achieved in a boiling liquid cooling system for an internal combustion engine including a coolant inlet and coolant outlet, the cooling system including a separation tank coupled to the coolant inlet and coolant outlet for separating vaporized coolant from liquid coolant, condenser means coupled to the separation tank for condensing vaporized coolant flowing from the separation tank to the condenser means, sump means coupled to the condenser means for receiving condensed coolant from the condenser means, the sump means being coupled to the separation tank for returning liquid coolant to the separation tank and to the engine, and vent means for venting noncondensible gases from the cooling system to the atmosphere during operation of the engine. The improvement comprises the vent means being coupled to the sump means and the condenser means including means for preventing the flow of vaporized coolant from the condenser means into the sump means during high ambient air temperature engine operating conditions. The cooling system further comprises means coupled to the sump means and the separation tank for preventing the flow of vaporized coolant from the separation tank to the sump means during engine operating conditions under which there is an absence of coolant flow from the sump to the separator tank, whereby the flow of vaporized coolant from the cooling system to the atmosphere through the vent means is prevented under all engine operating conditions.

In one embodiment of the invention, fan means is disposed adjacent the condenser means for drawing ambient air over the condenser means, and means responsive to the presence of vaporized coolant at a selected location in the condenser means, such as temperature sensing means responsive to the temperature of vaporized coolant at the selected location in the condenser means, is coupled to the fan means for actuating the fan means. Liquid flow restrictor means may also be coupled to the condenser means for restricting the flow of coolant condensed by the condenser from the condenser means into the sump means, the flow restrictor means causing the formation of a liquid coolant seal at the outlet of the condenser means.

The foregoing arrangement prevents the flow of vaporized coolant from the condenser means into the sump means during high ambient air temperature engine operating conditions. Thus, coolant vapor loss from the system at low vehicular speeds, which occur, e.g., during idling, hill climbing or when the vehicle is moving slowly, as well as during engine shutdown, is eliminated.

In another embodiment of the invention, the means for preventing the flow of vaporized coolant from the separation tank to the sump means may comprise non-return valve means which prevents the flow of vaporized coolant into the sump means in the absence of the flow of liquid coolant from the sump means to the separation tank. In this manner, coolant loss through the system vent during, for example, engine start-up, engine shutdown and while the vehicle is coasting downhill, is eliminated.

The foregoing objects of the invention are also achieved in a boiling liquid coolant system for an internal combustion engine having a cylinder block with at least one cylinder, a cylinder head, at least one inlet for coolant located in the lower part of the cylinder block and at least one outlet for coolant located in the cylinder head, the coolant system including a separation tank having a liquid coolant outlet in the lower part of the tank connected to the inlet of the cooling jacket, a vaporized coolant inlet connected to the outlet of the cooling jacket, a vapor outlet in the upper part of the tank, and a condensate inlet; a condenser having a vapor inlet in the upper part and a condensate outlet in the lower part; a condensate receiving sump having an inlet connected to the condensate outlet of the condenser; a vent connecting the system to the atmosphere; a condensate pump having an inlet communicating with the lower part of the receiving sump and an outlet connected to the condensate inlet of the separation tank; and means for driving the condensate pump to deliver condensed liquid coolant from the receiving sump to the separation tank.

In order to assure complete condensation of all coolant vapor generated under high ambient air temperature engine operating conditions, the condenser includes a temperature sensor at a selected location in the condenser; a fan positioned adjacent to the condenser; and means for driving the fan to flow ambient air in heat exchange relation with the condenser whenever the sensed temperature exceeds a predetermined value such that the fan operates whenever vaporized coolant is present at the temperature sensor location. In this way, positive ambient air flow past the condenser is provided at critical times such as, for example, hill climbing, hot weather idle, and after engine shut-down. In addition, the vent is connected to the upper part of the receiving sump and the condensate outlet of the condenser has a total cross-section for coolant flow which is limited to a predetermined value small enough to cause the formation of a liquid coolant seal prior to the inlet to the condensate receiving sump. The liquid seal seals the condenser outlet and retains the coolant vapor in the condenser during the period of time which elapses between activation of the fan and efficient air flow volume past the condenser.

The system also includes non-return flow means located between the receiving sump and the condensate inlet to the separation tank for preventing the flow of vaporized coolant from the separation tank to the sump in the absence of the flow of liquid coolant from the sump to the separation tank. In this way, no vapor can reach the receiving sump and vent through the alternate path of the condensate return line. Since the receiving sump provides the only communication with the atmosphere, the system vent is isolated and no coolant will escape from the system, yet noncondensible gases (e.g., air) can be readily eliminated through the vent. If the non-return flow means is located downstream of the condensate pump, it will also prevent hot vapor from reaching the pump and possibly damaging it.

Another practical problem faced in boiling liquid cooling systems, particularly in automotive applications where space is limited, is efficient and effective separation of liquid coolant entrained in the high velocity vapor stream leaving the engine cooling jacket.

Thus, a further object of the invention is to provide effective liquid/vapor separation in the improved boiling liquid cooling system of the invention. This additional object is achieved by providing the vapor inlet to the separation tank in the form of a tubular member having a predetermined length located within the separation tank, the tubular member having a closed end and a plurality of openings in the sidewall thereof for permitting flow of vaporized coolant therethrough from the engine into the separation tank. It is desirable that the total flow area of the plurality of openings in the sidewall of the tubular member be substantially greater than the internal cross-sectional area of the tubular member, so that the velocity of coolant vapor flowing through the openings will be less than its velocity entering the tubular member, thus avoiding violent agitation of the liquid in the separation tank and providing for separation of entrained liquid from the vapor. If the tubular member is positioned below the operating liquid level in the tank, the entering steam also will help to keep the replenishing liquid hot to maintain the desirably high lower cylinder wall temperatures in the engine and will also enhance initial precondensing of the coolant vapor.

Although boiling liquid coolant systems can provide warm up times faster than those of conventional pressurized liquid systems, there is a strong need to reduce warm up time still further. Warm up can take as long as 9 or 10 miles of driving for pressurized liquid systems. This may be reduced to 3 miles in a boiling system, but the warm up period is still a substantial part of the typical driving cycle and contributes a very large part of total CO and HC production because of the previously mentioned wall quenching effect. Overall emission of CO and HC pollutants will drop sharply if the warm up time can be reduced, and this is another object of the invention.

This object is obtained by providing means for circulating coolant in a direct path outside the cooling jacket between the lower part of the cylinder block and the cylinder head during at least the warm up period of the engine without significant heat loss from the circulated coolant. Such coolant circulation reduces the temperature differential between the top and bottom of each cylinder in the period before boiling starts, and also during operation of the engine after warm up.

The foregoing and other additional objects, features, and advantages of the present invention are more fully described in the following detailed description.

BRIEF DESCRIPTION OF THE DRAWINGS

FIG. 10 is a perspective view of still a further embodiment of a condenser comprising a vapor-pressure reduction chamber and expander.

FIG. 12 is a partial, schematic diagram of a boiling liquid cooling system constructed according to the present invention in which non-condensible gases are vented into an expansion tank instead of into the atmosphere.

DETAILED DESCRIPTION

Figure 1:
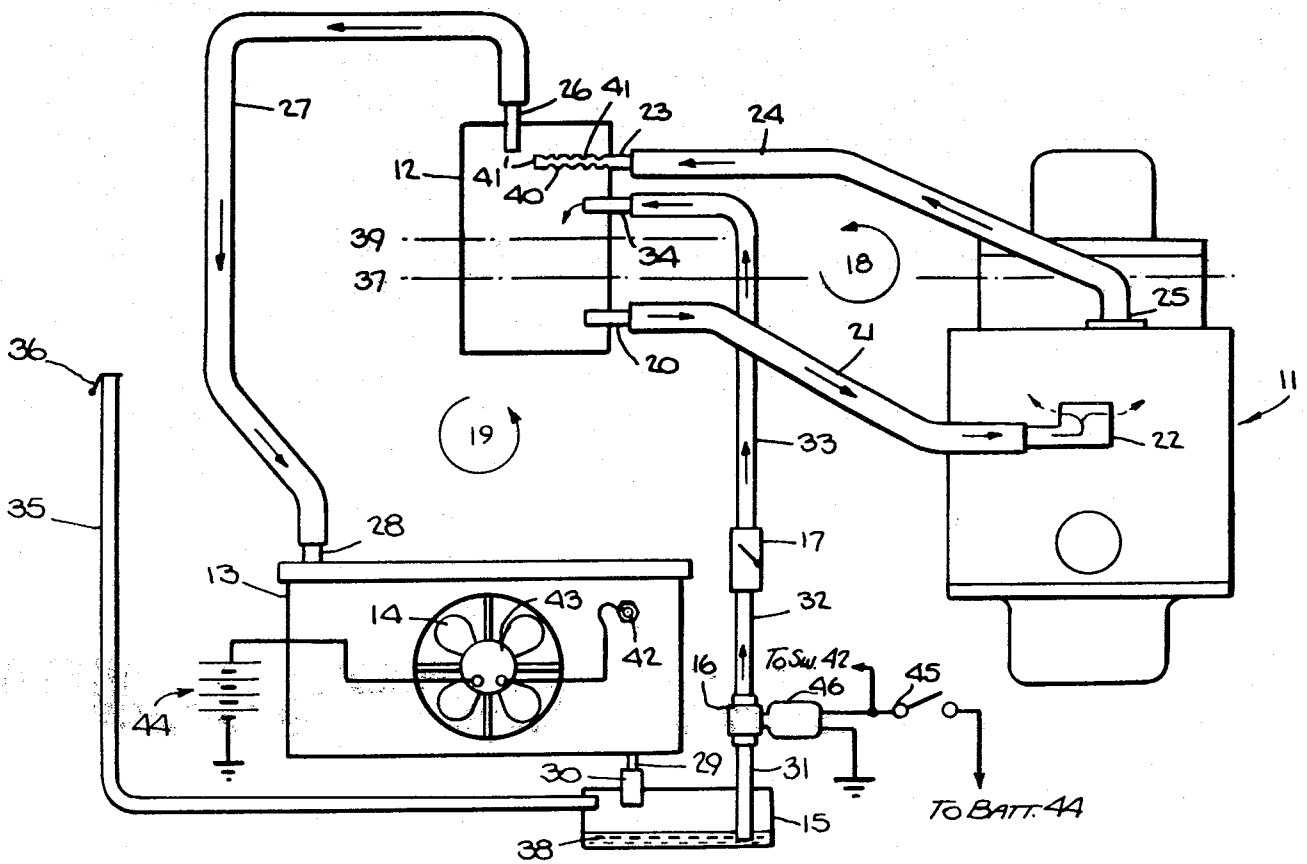
FIG. 1 is a simplified schematic diagram of a boiling liquid cooling system according to the invention.

With reference first to FIG. 1, there is shown a boiling water cooling system for an internal combustion engine 11 which includes a separation tank 12, a condenser 13, a fan 14, a receiving sump 15, a condensate pump 16, and a non-return flow control means such as check valve 17. These components are arranged in two circuits, an engine cooling circuit 18 and a vapor condensing circuit 19, the two circuits being interconnected by the separation tank 12, which also serves as a liquid coolant reservoir and as an expansion tank.

As will be described in greater detail later herein, the cooling system also includes a vent line coupled to the sump, and the condenser includes means for preventing the flow of vaporized coolant from the condenser into the sump during high ambient air temperature engine operating conditions. The check valve 17 prevents the flow of vaporized coolant from the separation tank to the sump during engine operating conditions under which there is an absence of liquid coolant flow from the sump to the separation tank. As a result, the vent is isolated from the vaporized coolant and the flow of vaporized coolant from the cooling system to the atmosphere through the vent is prevented under all engine operating conditions.

Separation tank 12 has two inlets and two outlets. A liquid coolant outlet 20 at or near the bottom of the tank connects through a conduit such as a hose 21 to an engine coolant inlet 22, typically at the front of the engine block. A vapor inlet 23 in the side of tank 12 receives a mixture of hot coolant liquid vapor delivered through a conduit such as hose 24 from one or more outlets 25 at the top of the cylinder head of the engine, thus completing the engine coolant circuit.

In the condensing circuit 19, the vaporized part of the heated coolant from the engine passes from a vapor outlet 26 at the top of the separation tank through a conduit such as hose 27 to an inlet 28 at the top of the condenser 13. The coolant leaves as condensed liquid from an outlet 29 at the bottom of the condenser and flows directly through conduit 30 into the receiving sump 15. The condensate pump 16 draws condensed coolant from the receiving sump 15 through a line 31 and delivers it through a conduit 32, check valve 17, and via a condensate return line 33 to a condensate inlet 34 in the side of the separation tank 12, to complete the condensing circuit. A vent line 35 leading from the upper part of receiving sump 15 provides the only connection between the cooling system and the atmosphere. The vent line either may be left open or may be capped with a simple flap valve 36.

The separation tank preferably is mounted so that at least part of it is above the level of liquid coolant in the engine coolant passages when the engine is cold. In this condition the cylinder block and cylinder head are filled with liquid coolant to a level 37. The condensing circuit is empty, except for possibly a small amount of coolant 38 in the receiving sump. Thus, the system requires only enough liquid coolant to fill the engine coolant passages and the hose 21, and to partially fill the hose 24, when the engine is cold. This means that the system requires the minimum possible amount of coolant; thereby reducing total vehicle weight and decreasing warm up time. The total volume of coolant required by this arrangement is approximately one-third that required for any given engine cooled by conventional means. Warm up time is reduced correspondingly because the mass of liquid to be heated is smaller. Also, the smaller amount of liquid requires a small separation tank to accommodate expansion of the liquid, which may be as much as 25 percent to the vapor point. This is particularly true when the tank is empty at cold start, as in the embodiment of FIG. 2. It should be emphasized, however, that the separation tank can be mounted anywhere and the liquid coolant pumped to the engine, if desired.

When the engine is first started, the coolant does not flow through the coolant circuit because there is no continuous liquid path to support thermal circulation. As the engine runs, the liquid coolant in the engine warms up and expands, raising the liquid coolant level in the separation tank to a normal operating level 39. A mixture of coolant liquid and vapor begins to enter the separation tank through the vapor inlet 23. In the embodiment of FIG. 1, this inlet is located above the highest level 39 reached by the liquid coolant in the tank and is formed by a tubular member 40 which extends through the side wall of the tank for a substantial distance into the tank.

The wall of the portion of the pipe 40 inside the tank 12 is perforated with a plurality of holes 41, and the end is closed with a cap 41', so that the vapor and liquid can enter the tank only through the perforations in the pipe wall. If the inlet 23 is located below the hot liquid operating level 39, only the lower part of the pipe is perforated, causing all of the vaporized coolant to bubble through the coolant liquid in the bottom of the tank before reaching the upper part. This combines the advantages of condensing some of the vapor and of maintaining the liquid temperature in the separation tank at very close to the boiling point. As the coolant in the engine continues to vaporize, this hot liquid flows by gravity through the liquid coolant outlet 20 to the coolant inlet 22 of the cylinder block, so a continuous replenishment of coolant at a substantially uniform temperature occurs through the coolant circuit. The replenishment rate is equal to the boiling rate of the coolant in the engine because there is no circulating pump in the engine coolant loop 18.

Meanwhile, the vapor part of the hot coolant entering the separation tank passes through the vapor outlet 26 to the inlet 28 of the condenser, which may, for example, be of finned-tube construction. A multiple vertical tube type of condenser, like a conventional automobile radiator, has been used in prior art systems, but the maximum possible length of individual tubes, particularly in modern low-profile automobiles, is too short to prevent loss of coolant vapor into the receiving sump and thence to the atmosphere through the vent. Thus, it is preferred to use a serpentine type of condenser, in which one or more long tubes are bent to form a multiplicity of horizontal passes. Such condensers typically have two tubes bent in parallel. Vapor entering the inlet end of each tube at the top of the condenser flows downward back and forth through successive horizontal passes. Because of the multipass arrangement, the total flow path length can be made long enough so that all of the vapor entering at the top is condensed by the time it reaches the outlet end of each tube at the bottom.

As a practical matter, however, the length of the condenser tubes is limited due to design considerations, i.e., the amount of space available in the engine compartment of a vehicle to accommodate the condenser, and as a result, even such a serpentine-type condenser will not have the capacity to condense all the vaporized coolant generated under high ambient air temperature engine operating conditions before the vapor reaches the end of the tubes. Thus, in the present invention, as will be described in detail later herein, a thermally-actuated fan is disposed adjacent the condenser to increase ambient air flow over the condenser during high ambient air temperature engine operating conditions and thereby assure condensation of the vaporized coolant before it reaches the ends of the condenser tubes. A condenser outlet is also used which restricts the flow of condensate from the condenser to the sump so as to form a liquid seal at the outlet which prevents vaporized coolant from escaping from the condenser until the fan increases the rate at which the vapor is condensed and thereby matches the condensation rate to the vapor generation rate. This arrangement enables the dimensions of the condenser to be smaller, and the length of the condenser tubes to be reduced, while at the same time assuring that vaporized coolant will not enter the sump from the condenser and be lost to the atmosphere through the system vent.

The condenser may be placed in front of the engine, in the space normally occupied by the radiator in conventional pressurized liquid systems. This location provides the benefit of a normal flow of ambient air past the condenser tubes when the vehicle is moving. Because of the greater heat transfer rate from vapor than from liquid, the condenser can be smaller than a radiator of a pressurized liquid cooling system for the same engine. This allows room for the separation tank in part of the space normally occupied by the radiator.

To assure sufficient air flow across the condenser tubes to condense vapor generated during high ambient air temperature engine operating conditions, such as when the vehicle is stopped or moving slowly, and thereby prevent the flow of vapor from the condenser into the sump under such conditions, the electric fan 14 is arranged to flow ambient air across the tube passes. The fan is connected directly to the storage battery of the vehicle through a normally-open thermal switch 42 located in the condenser, preferably within approximately the last third of the distance from the inlet to the outlet.

The switch connects the fan motor 43 to a source of electric power such as a battery 44, and is set to close at a temperature corresponding approximately to the vapor temperature of the coolant at the operating pressure. As the engine warms up, vaporized coolant begins to displace the air in the separation tank, forcing it down through the condenser tubes to the receiving sump and thence out the vent. Because the condenser tubes are cold at start up, the initial vapor flow will condense in the upper part of the condenser and will then flow down the tubes toward the outlet. As the engine warms up and load increases, the condensate flow will increase until liquid condensate fills the outlet of the condenser, which has a diameter less than that of the condenser tubes and functions as a flow restrictor, to form a liquid seal at the condenser outlet.

Depending on engine load, ambient air temperature, and normal air flow past the tubes, the condenser tube wall temperature in the vicinity of the thermal switch may rise to the vapor temperature, causing the switch to close and start the fan. The flow of ambient air from the fan will cool the condenser tubes, lowering the temperature at the switch location and causing the switch to open. In this way, the condensing capability of the system is matched to the vapor generating rate of the engine for all operating conditions. Operation is such that the system is first deaerated after start up, with all vapor being condensed. When vapor generation rate exceeds a certain value, the liquid condensate seal formed at the condenser outlet prevents the passage of any coolant vapor to the receiving sump and consequent loss through the vent line until the fan has had sufficient time to increase the condensation rate of the condenser.

The condenser may be located anywhere in the air stream over or under the vehicle, for example, underneath the chassis, inside a fender well, or at the rear exit of the air flowing under the vehicle. It should also be noted that the condenser design is not limited to the above-described serpentine-type condenser, but may also comprise other suitable arrangements, such as, for example, a two-layer sandwiched body panel (e.g., hood, roof, trunk) including condenser tubes.

Starting the engine (by closing the start switch 45) also starts the condensate pump, which in the embodiment of FIG. 1 is driven by an electric motor 46. When the pump motor is actuated, the pump will run while the engine is running and coolant will be pumped from the receiving sump. Thus, the sump will have only a minimum amount of liquid coolant at any time. This minimizes evaporation loss from liquid coolant in the sump and also keeps essentially all of the liquid in the system in the engine coolant loop, except for whatever is flowing within the condenser during system operation.

Because the condenser with its thermally-actuated fan is able to condense all of the vapor as it is generated, the system will operate at or close to atmospheric pressure under any normal operating condition. Thus, the engine can, for example, be operated at full power or can idle at a standstill on hot days without loss of coolant through the vent.

After the engine is turned off, the coolant in the water jacket will continue to boil until the heat of the engine is sufficiently dissipated. The vapor thus generated will all be condensed, because the fan motor will continue to run as long as there is vapor in the condenser at the thermal sensor location. As the engine cools, the flow of condensate will decrease and drain from the condenser into the sump until there is no longer a liquid seal formed by the condensate at the outlet of the condenser. At this point, however, the pressure in the system will be close to atmospheric or even below, so no vapor will be lost through the vent. As the liquid coolant and vapor cools, the volume of liquid in the separation tank will decrease and create a vacuum which draws and empties the condensate from the sump thereby preventing the loss of coolant through the vent due to evaporation of condensate left in the sump after engine shutdown.

It should be noted that the thermal switch 42 may also comprise a pressure switch disposed in the same location as the thermal switch 42 in the condenser. Such a pressure switch, set to detect a predetermined pressure level in the condenser tube, will close and connect the fan motor to battery 41 in the same manner as switch 42. Since the last third of the condenser tube will operate at about atmospheric pressure due to the fact that it is located at a point after the vapor collapse point, any rise in pressure will indicate the presence of vaporized coolant in this area. The air flow across the condenser generated by the actuated fan causes the vapor to collapse and reduce to a condensate thereby reducing the pressure in the condenser tube. At this point, the switch will open and the fan will stop operating.

Figure 2:
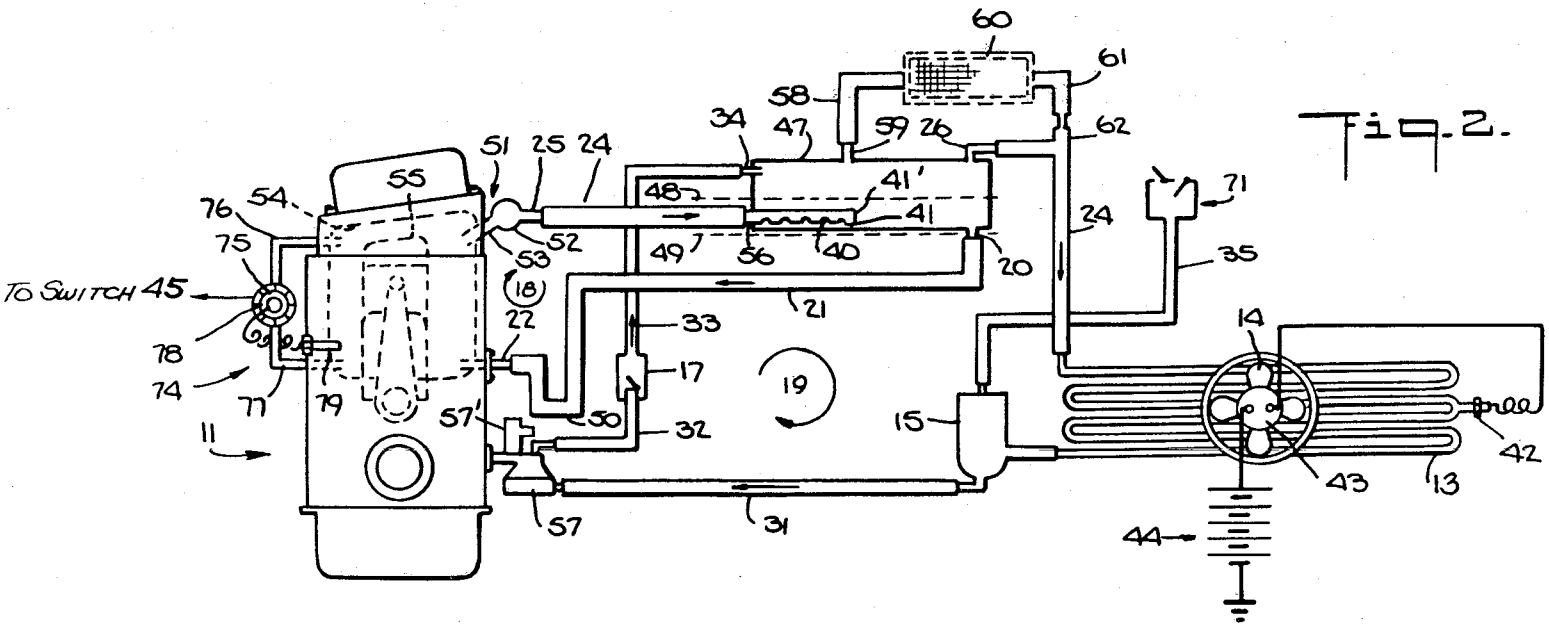
FIG. 2 is a simplified schematic diagram of an alternative embodiment of the boiling liquid cooling system of the invention.

With reference next to the alternative embodiment of the engine cooling system as shown in FIG. 2, elements which are the same as those in FIG. 1 are identified by the same reference numerals. This embodiment also includes an engine cooling loop 18 and a condensing loop 19 interconnected by a separation tank 47.

The separation tank in this embodiment is particularly adapted for mounting in an engine compartment having minimum vertical clearance, as is typical of modern automobiles. Tank 47 is an elongated cylinder mounted horizontally. The normal operating liquid level 48 is approximately at the center line of the tank, but the normal liquid coolant level 49 when the engine is shut down and cold is below the bottom of the tank. This arrangement provides the greatest amount of expansion space for a given size of tank. Although the tank may be made of metal, the low operating pressure of the system allows lighter materials, such as thermosetting plastics, to be used, resulting in substantial weight and cost savings.

As in the arrangement of FIG. 1, liquid coolant flows by gravity from the separation tank liquid coolant outlet 20 through a conduit 21 to the engine coolant inlet 22. The embodiment of FIG. 2, however, includes an additional feature in the form of a U-trap 50 which prevents any vapor bubbles in the engine cooling jacket from entering the supply line 21 and impeding the replenishment of liquid coolant to the engine.

Figure 3:
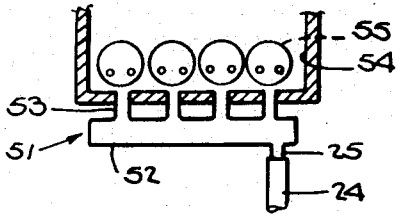
FIG. 3 is a top view, in simplified schematic form, of a vaporized coolant outlet manifold shown in FIG. 2.

Another modification shown in FIGS. 2 and 3 is the provision of a "log-type" outlet manifold 51 having a tubular chamber 52 with individual inlet branches 53 connected to the uppermost part of the cylinder head cooling jacket 54 in the vicinity of each cylinder 55 in a horizontal plane even with the uppermost part of the jacket. This manifold arrangement has been found to markedly improve the uniformity of cylinder head temperatures, both from cylinder to cylinder and from bottom to top of each cylinder head cooling jacket. The manifold eliminates the formation of pockets of vapor at the top of the cylinder head.

Vapor leaves the manifold 51 through outlet 25 and passes through conduit 24 into the separation tank vapor inlet 56. In this embodiment, the vapor inlet is located below the operating hot liquid level 48 in the separation tank. As in FIG. 1, the vapor inlet is a perforated tubular member with a capped end, but in this case only the lower part of the wall of the tubular member is perforated with holes 40. This creates a longer path for the vapor entering the separation tank, after the coolant has expanded to a level above the tubular member, to bubble up through the liquid in the tank, thereby helping to maintain the liquid temperature close to the boiling point.

The condensing loop 19 in the embodiment of FIG. 2 is arranged essentially the same as in FIG. 1, except that the electrically-driven condensate pump is replaced by a simple and economical alternative in the form of an engine-driven mechanical pump, shown here as a diaphragm type pump 57 having a second stage 57' for pumping fuel. This pump will be described in more detail in connection with FIG. 6. Since the rate of heat generation by the engine is roughly a function of engine speed, the pumping rate of an engine-driven pump will tend to vary with the condensing rate. It is only necessary to size the pump to handle the condensate flow at maximum engine load at low speed to make sure that the receiving sump is maintained essentially pumped dry under all operating conditions. If any condensate is in the receiving sump at start up (from the previous engine cool down), it will be pumped out before any coolant expansion from the warming engine forces noncondensible gases, drawn in through the vent during cool down, back out through the vent. By evacuating the sump before this flow of noncondensible gases, there cannot be any flow of coolant with these gases out the vent.

Another feature added to the system in FIG. 2 is a passenger compartment heater circuit, which includes a vapor supply line 58 extending from an outlet 59 in the top of the separation tank to a conventional automobile heater core 60, shown in dashed lines. A vapor return line 61 connects the outlet of the heater core to an inlet 62 in the vapor conduit 24 leading to the condenser.

Figure 4:
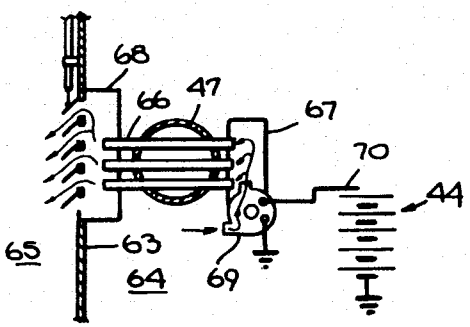
FIG. 4 is an end view, in cross-section, of an alternative passenger compartment heater arrangement for the cooling system in FIG. 2.

An alternative heater arrangement is shown in FIG. 4. In this arrangement, the separation tank is mounted on the engine side of a firewall 63 between the engine compartment 64 and the passenger compartment 65 of an automobile. A multiplicity of heat transfer tubes extends transversely through the separation tank between an incoming air plenum chamber 67 and an outgoing air plenum chamber 68. A fan 69 actuated by a switch 70 discharges ambient air into the incoming plenum, from which it flows through the heat transfer tubes to outgoing plenum 68 for distribution into the passenger compartment. This alternative arrangement is preferred because it eliminates the need for a separate heater core.

Figure 5:
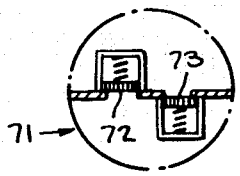
FIG. 5 is an enlarged detail view, in cross-section, of an alternative embodiment of a dual pressure/vacuum relief valve arrangement shown in FIG. 2.

As an alternative to the simple flapper valve or open vent arrangement for the receiving sump, as previously described in connection with FIG. 1, the embodiment of FIG. 2 is provided with a combination pressure and vacuum relief valve 71. This valve, which is illustrated in enlarged detail in FIG. 5, includes a spring-loaded pressure relief valve 72 and a spring-loaded vacuum relief valve 73. Each valve may be set independently to any desired gauge pressure. A typical setting for the pressure valve may be between about one-fifth and about one atmosphere (gauge), and for the vacuum valve about one-thirtieth atmosphere (gauge). This alternative arrangement permits a higher boiling temperature to be achieved with a given coolant, thereby further increasing the lower cylinder wall temperatures and reducing still further the production of CO and HC. The foregoing pressure and vacuum settings are merely illustrative. The maximum pressure and vacuum settings are limited only by the strength of the various components in the system. The valve allows for the exhausting of noncondensible gases drawn in through the vacuum relief during engine cool down and permits the system to breathe while operating.

Any suitable ebullient coolant can be used, such as water, or water/alcohol. An excellent coolant formulation for spark ignition engines is a mixture of alcohol with ethylene glycol. The latter material raises the boiling temperature of the coolant above that of the water/alcohol mixture and reduces its susceptibility to evaporation. The higher boiling temperature (about 105° C. at atmospheric pressure) of the alcohol/ethylene glycol mixture allows the cylinder bores to run hotter, resulting in measurably reduced output of pollutants in the exhaust gases. It has also been determined that pure ethylene glycol is an excellent coolant for diesel engines. In both cases, the elimination of water as a coolant eliminates the formation of rust, scale, sediments and sludging. In addition, as the ratio of glycol to alcohol increases, the volume of vapor generated by the engine decreases, which enables the components of the cooling system to be smaller in physical size and dimensions. It has also been found that other coolants of non-petroleum origin such as liquid silicones may be used in such a system.

A final feature illustrated in FIG. 2 is a warm up circulating loop 74 which includes a circulating pump 75 directly connected by conduits 76 and 77 between the upper and lower parts, respectively, of the cooling jacket. Pump 75 is driven by an electric motor 78 actuated by a thermal switch 79 extending into the cooling jacket. The thermal switch is set to shut below a predetermined temperature, preferably approximately equal to the boiling temperature of the coolant. The pump motor is connected to the battery through the start switch so that it operates only when the engine is running but has not yet warmed up to operating temperature. Because the separation tank creates a two phase broken loop system, there is no natural circulation in the engine cooling loop until boiling starts, so no heat can leave the cylinder block through that path during the warm up period.

Preferably the pump circulates initially warmed coolant liquid from the upper part of the cooling jacket down to the lower part, thus displacing cold coolant, which rises and is itself warmed by the hotter temperatures in the upper ends of the cylinders. Alternatively, circulation can be in the opposite direction, if desired. As soon as the engine warms up enough to open thermal switch 79, the circulating pump 75 will stop. At this point normal boiling cooling takes over.

Instead of using a separate electric circulating pump, the warm up circulating line can, for example, be connected directly to a conventional water pump located at the front of the engine. Since the main engine cooling loop 18 does not require a circulating pump, its inlet can be relocated elsewhere. Because the engine driven circulating pump has a high capacity, it is desirable to remove most of its blades. Two blades have been found to provide adequate circulation. If circulation from upper to lower cooling jacket is chosen, the circulation through the warm up line stops automatically when boiling begins and the upper part of the cooling jacket fills with vapor because the liquid coolant path is broken.

Use of the direct warm up circulation loop has been found to dramatically reduce engine warm up time. For example, during normal driving on a day when the ambient temperature is about 8° C., a 1979 Ford six cylinder Granada equipped with a boiling coolant system as in FIG. 2 takes about 3 miles to warm up with the warm up loop disconnected. When the warm up loop is operating, the engine wram up time is reduced to less than 1.5 miles.

Figure 6:
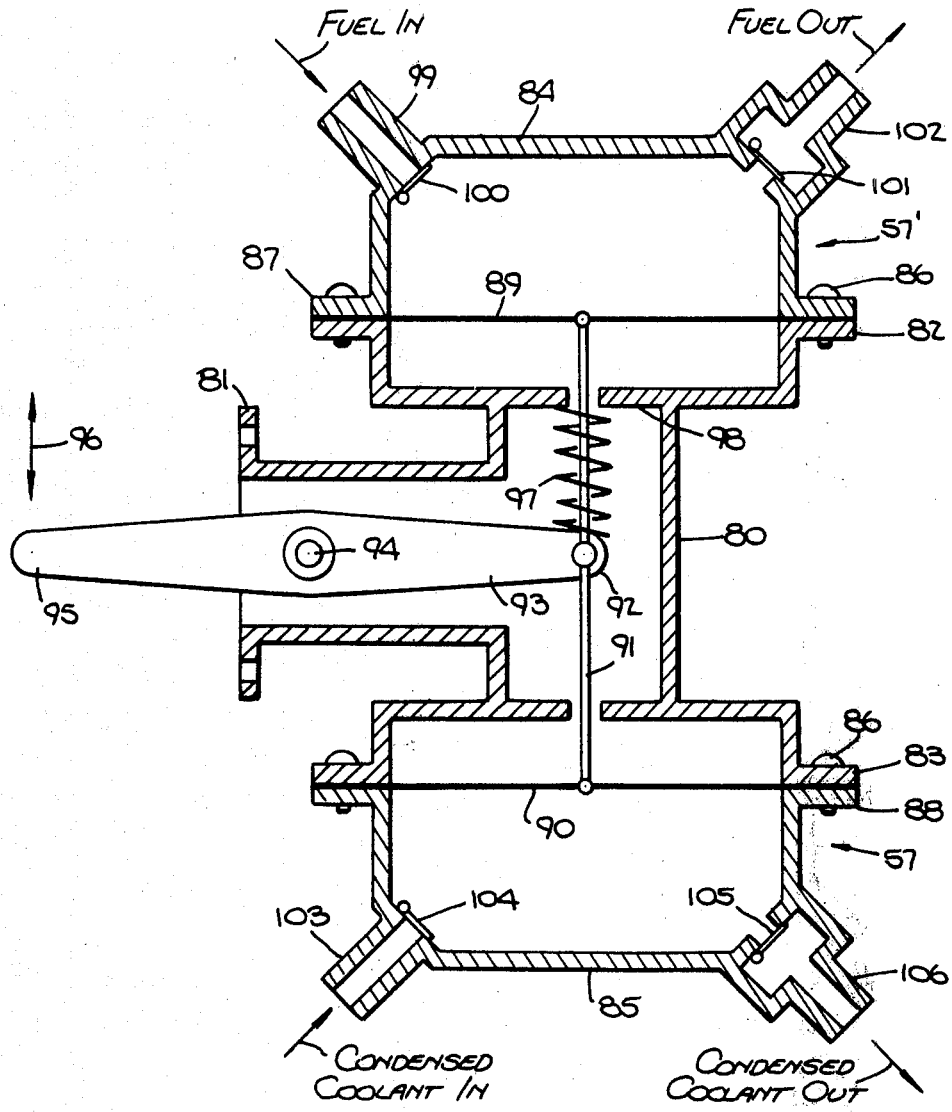
FIG. 6 is a cross-sectional view of a double-diaphragm pump for pumping fuel and condensed coolant as in the embodiment of FIG. 2.

With reference to FIG. 6, which shows in more detail and in partially schematic form the dual-diaphragm pump 57, 57' of FIG. 2, the pump includes a T-shaped housing 80 having a drilled flange 81 for mounting on the engine block, in place of the conventional single-diaphragm fuel pump. Housing 80 also has a drilled and tapped upper flange 82 and a corresponding lower flange 83 to which are fastened a fuel pump chamber 84 and a condensate pump chamber 85, respectively, by machine screws 86. The chambers 84, 85 have flanges 87 and 88, which mate with flanges 82 and 83, respectively, to sealingly clamp elastic diaphragms 89 and 90, respectively.

An articulated rod 91 connects each diaphragm to one end 92 of a lever 93 pivoted on a pin 94. The other end 95 of lever 93 is reciprocated, as shown by arrow 96, by a conventional push rod (not shown) driven by the camshaft of the engine to flex the diaphragm against the biasing force of a compression spring 97, which is disposed between the one end 92 of the lever and a stepped portion 98 of the pump housing.

Downward movement of diaphragm 89 draws fuel into pump chamber 84 through inlet tube 99, which is connected to the fuel supply tank (not shown) and one way valve 100, while upward movement of diaphragm 89 expels the fuel through one-way valve 101 and outlet tube 102, which is connected to the engine fuel delivery means, such as a carburetor (not shown).

Similarly, upward movement of diaphragm 90 draws condensed coolant through inlet tube 103 and one-way valve 104 input pump chamber 85, and downward movement of diaphragm 90 expels the coolant through one-way valve 105 and outlet tube 106. Inlet tube 103 will be connected to condensate line 31 of FIG. 2, and outlet tube 106 will be connected to line 32.

It will be apparent to those skilled in the art that one-way valve 105 performs the same function as check valve 17 in FIG. 2, so that the latter can be dispensed with. Instead of the one-way flap valves shown in the pump, spring-loaded ball valves can be substituted, if desired.

As evidence of the improvement in fuel economy and reduced exhaust emission that can be obtained with the boiling coolant system of the invention, the same Ford Granada mentioned above has averaged during testing about 25% improvement in miles per gallon, a reduction of NOx of about 30% and a reduction in CO and HC of about 20% in comparison with its performance when the normal pressurized liquid coolant system is operating.

The system described immediately above (FIGS. 1–6) will operate at atmospheric pressure, or slightly above with a maximum pressure of 3–5 p.s.i. A lower pressure system, however, can be achieved by the use of a specially-designed condenser which permits the system to operate at a pressure ranging from atmosphere to a maximum of 2 p.s.i.

The essential concept of this condenser is that it is not only a heat exchanger but also an expansion chamber. The condenser has the capacity to accept the total volume of vapor generated by the engine during all engine operating conditions without offering resistance to the flow of the vapor into the condenser. The condenser is thus designed so as to cause an expansion of the vaporized coolant, and a reduction of the pressure of the vapor, as the vapor flows from the engine and separation tank into the condenser. This concept may be achieved in several ways: (1) by a multi-pass condenser the tubes of which have a cross-sectional diameter which is greater than the diameter of the vapor conduit, preferably about at least 2 times greater than the diameter of the vapor conduit; (2) by an air-cooled chamber into which the vaporized coolant flows and expands which may include baffles and is cooled by internal air tubes or external fins; or (3) by a chamber constructed from a chassis component of the vehicle having a large surface area, for example, the hood or roof of the vehicle, which is laminated with a heat reflective plastic.

Figure 7:
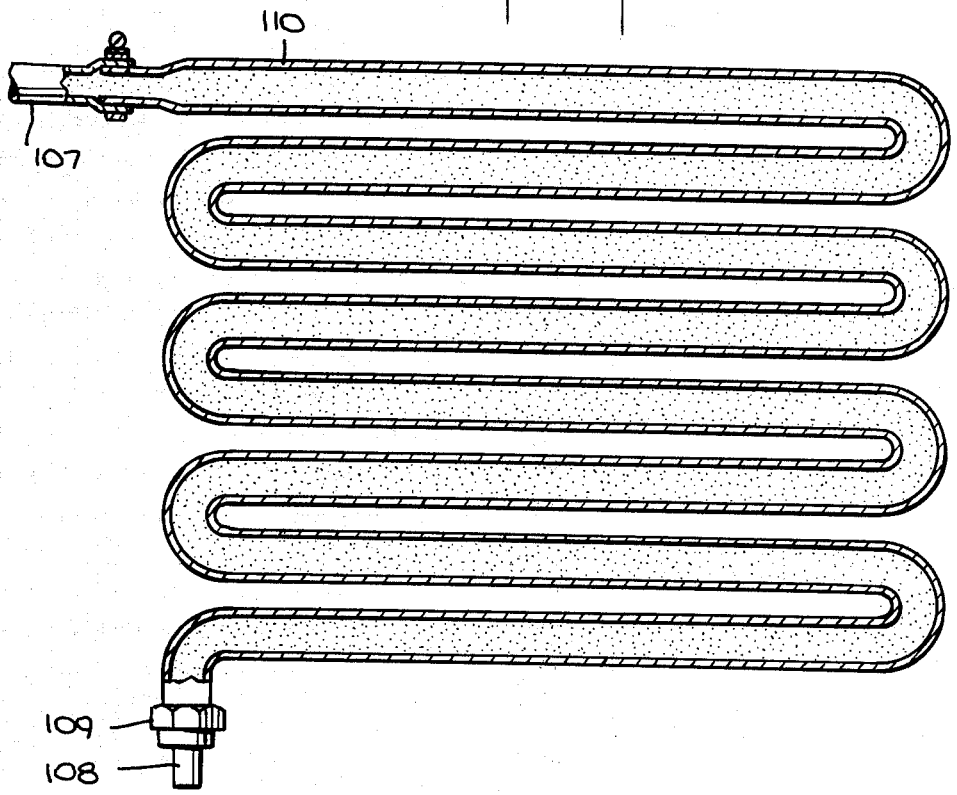
FIG. 7 is a cross-sectional view of one embodiment of a condenser for a boiling liquid cooling system according to the invention.

Referring now to FIG. 7, there is shown one embodiment of such a condenser which includes a vapor inlet 107 coupled to the engine and a condensate outlet 108. A variable diameter orifice 109 is coupled to the end of the condenser tube to regulate the formation of the liquid seal previously described with reference to FIGS. 1 and 2. The inside diameter of condenser tube 110 is larger than the inside diameter of inlet 107, and preferably has a diameter which is about twice as great as the diameter of inlet 107, i.e., a ratio of 2:1.

In operation, vapor flows from the engine through inlet 107 into the larger volume of tube 110 and immediately expands and its velocity decreases. This reduction in velocity and the expansion of the vaporized coolant greatly enhances the rate of condensation of the vaporized coolant in the condenser. Moreover, the increased volume into which the vapor expands eliminates condenser resistance to the flow of vapor into the condenser from the separation tank. Thus, an increase in engine operating pressure under heavy load is eliminated.

Figure 8:
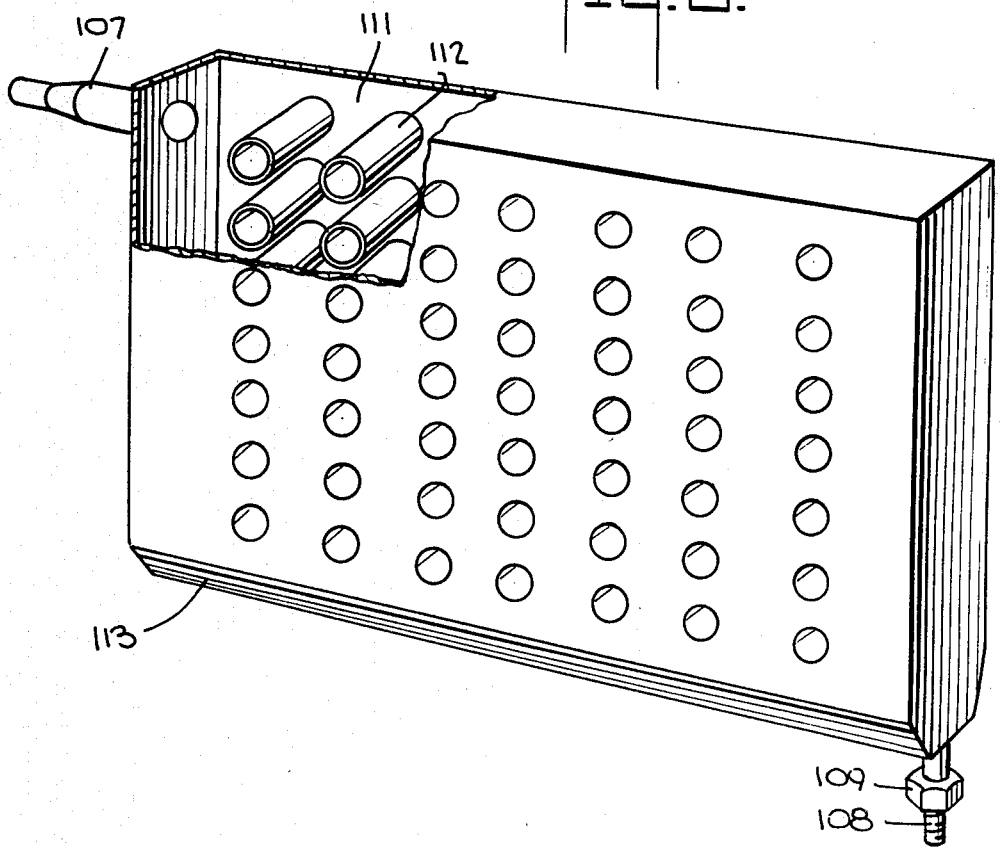
FIG. 8 is a perspective view, partially in section, of one embodiment of a condenser comprising a vapor pressure reduction chamber and expander for a boiling liquid cooling system according to the invention.

FIG. 8 illustrates another embodiment of the condenser in which the condenser includes a large volume chamber 111 in which the vapor space for expansion of the vaporized coolant for a given frontal area of the condenser is increased by a ratio of about 10 to 1 over the volume for expansion of the vapor provided by the condenser of FIG. 7. In operation, the vaporized coolant enters into chamber 111 and immediately expands due to the greatly increased volume of the chamber relative to vapor inlet 107.

The expansion of the vapor causes a reduction of the velocity and pressure of the vapor upon entering chamber 111 and the vapor tends to fill the uppermost part of chamber 111. A plurality of hollow tubes open at each end are transversely disposed in the chamber. The tubes are constantly cooled by ambient air forced through the tubes by the vehicle motion or a fan, and as the vaporized coolant contacts the tubes it condenses and drips down through the chamber and collects at the bottom in a channel 113. A liquid seal is formed by variable orifice 109 as previously described, and the condensate flows from the condenser from outlet 108.

Figure 9:
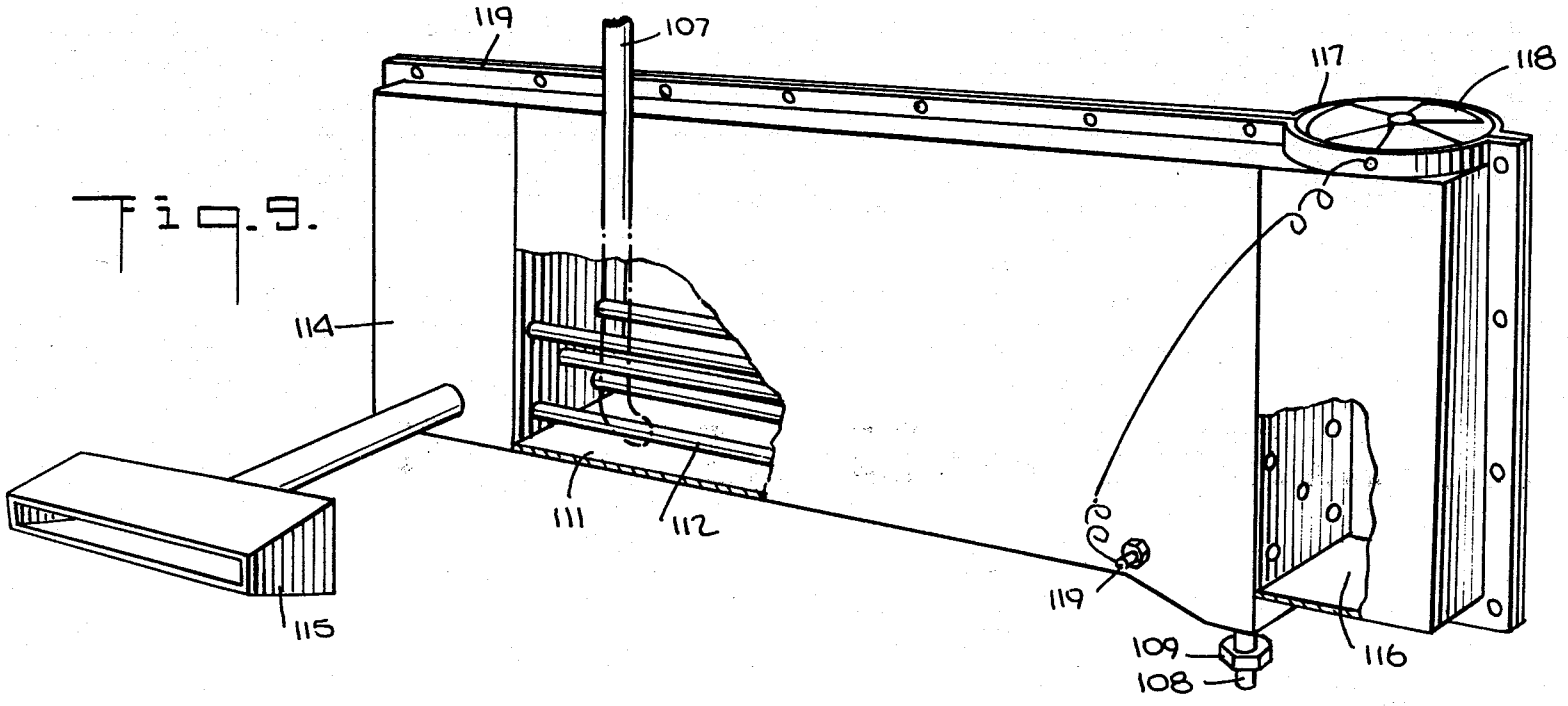
FIG. 9 is a perspective view of another embodiment of a condenser comprising a vapor pressure reduction chamber and expander.

FIG. 9 illustrates another embodiment of the condenser which permits the grille area of the vehicle to be completely sealed for improved aerodynamics. This condenser may be remotely mounted in the vehicle and a cold air plenum 114 is used to feed air from a cold air intake nozzle 115 which is mounted in any air flow source, e.g., under the bumper of the vehicle.

In operation, cold air from plenum 114 flows through and cools tubes 112. Heated air is then forced through a hot air plenum 116 and out of the condenser through fan shroud 117. A fan 118 is actuated by a sensor 119 which detects vapor reaching the lower portion of chamber 1 by means of the vapor temperature as previously described. When actuated by the sensor, the fan draws air from cold plenum 114 and intake nozzle 115 through tubes 112 and into hot air plenum 116 to cool the vapor. Vaporized coolant enters chamber 111 of the condenser through inlet 107, which is preferably located at the bottom of the chamber in order to maintain the temperature of the condensate at the bottom of the chamber at or near the temperature of the liquid coolant in the engine and enhance the efficiency of the condensation of the vapor in the chamber, but may be located in any convenient position, is condensed and the resulting condensate flows from the condenser from outlet 108 which also includes a variable orifice 109.

The condenser may be fabricated of molded plastic in two halves each including a sealed flange 119. The tubes 112 may be constructed of aluminum or copper and may be sealed with O rings at the points they pass through the walls of plenums 114 and 116.

In an alternate embodiment of the condenser, the condenser may comprise a body panel, e.g., the hood of the vehicle. In operation, the vaporized coolant enters chamber 111 through inlet 107. The tubes 112 extend from the front to back edges of the hood of the vehicle and direct cold air from the grille at the front of the vehicle to the louvers at the base of the windshield where the air exits as heated air. This exit area at the base of the windshield may be shrouded and include a fan. In most instances, however, the size of the reduction chamber should be large enough to eliminate the need for the fan to adjust the condensation rate of the vaporized coolant in the chamber.

The bottom of the chamber includes a centrally located channel 113 into which condensate flows. A variable orifice 109 is coupled to a condensate outlet 108 coupled to channel 113 of the condenser.

In order to minimize heating of the condenser by direct solar radiation, the hood may be coated with a heat reflective clear laminate.

Figure 11:
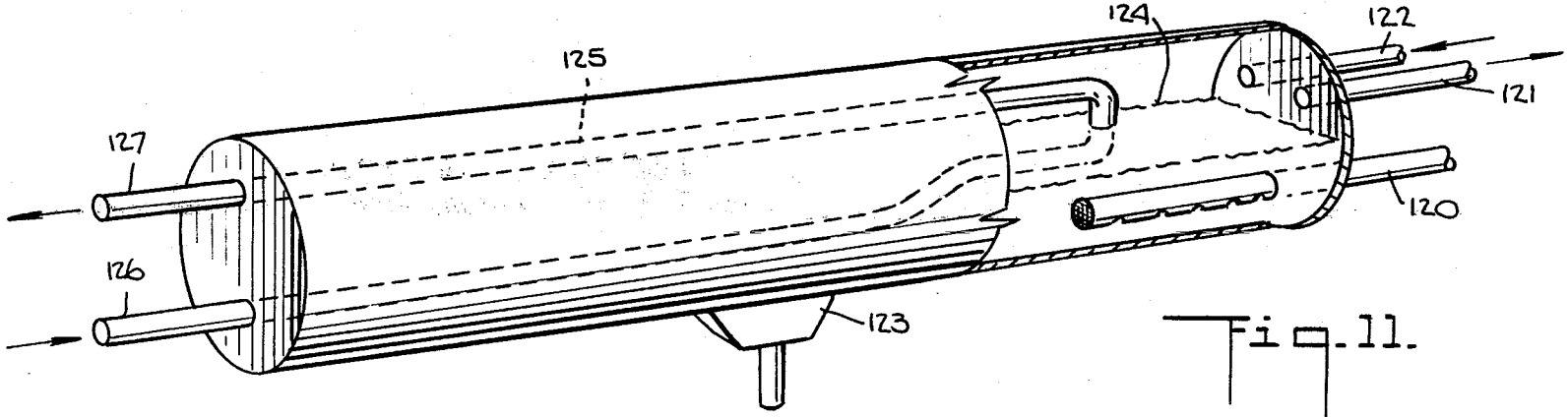
FIG. 11 is a perspective view, partially in section, of a separation tank for the boiling liquid cooling system of the invention which is adapted to control oil temperature.

Referring now to FIG. 11, there is shown another embodiment of the separation tanks illustrated in FIGS. 1 and 2. The tank includes a vapor inlet 120, a vapor outlet 121 which is coupled to the condenser, and a condensate return inlet 122. A liquid coolant return outlet 123 is coupled to the sump, and the hot coolant operating level of the tank is illustrated by dashed lines 124. An oil conduit tube 125 coupled to the engine oil pump outlet extends through one end of the tank in the form of a loop and is exposed to the heated atmosphere inside of the tank. The loop formed by the tube extends at least partially below and preferably fully below the hot coolant line 124. In operation, whenever the engine is running, oil flows through oil conduit tube 125 either directly or via a shunt. As the engine warms up, the initial expansion of hot coolant to level 124 submerges part of conduit tube 125 under hot liquid coolant. Cold oil flowing through conduit tube 125 through the inlet 126 of the loop is immediately heated by hot liquid coolant and flows back to the engine through outlet 127. As the engine reaches its operating temperature and vapor fills the separation tank through inlet 120, the water is superheated and the upper portion of the separation tank will be filled with steam which surrounds conduit tube 125; further oil preheating thus takes place. The temperature of the oil flowing through the conduit tube 125 is rapidly raised relative to typical temperature rises in engines not utilizing such an oil temperature control device.

The separation tank will effectively normalize the oil to an optimum temperature of 180°–200° F., which is the ideal temperature for oil according to specifications of the American Petroleum Institute (A.P.I. Specs). Should the oil entering the tank through inlet 126 be at a temperature in excess of 200° F., the vaporized coolant atmosphere of the separation tank will cool and reduce the oil temperature as it passes through conduit tube 125. This separation tank limits the effect of ambient air on the oil stored in the engine pan, and when oil flows directly to the tank from the engine, the temperature of the oil returning to the engine will range between 180° and 200° F. irrespective of the temperature of the oil in the pan. Moreover, such oil temperature control reduces engine friction during operation.

FIG. 12 illustrates another embodiment of a vapor cooling system of the invention in which the system is closed to the atmosphere. In this system, an expansion tank 128 is coupled by a conduit 129 to the sump 130 of the system. Although any of the foregoing condenser designs may be used, a condenser 131 of the type described with reference to FIGS. 8–10 is preferably utilized. In this embodiment, non-condensible gases are forced by coolant expansion and vapor into the expansion tank 128 during warm-up. By matched sizing of the expansion tank 128, reduction chamber 131, and coolant volume, a predetermined fixed pressure level may be set and a virtually constant engine operating temperature may be achieved with the advantage of having a totally closed system.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. In a boiling liquid cooling system for an internal combustion engine including a coolant inlet and a coolant outlet, said cooling system including a separation tank coupled to said coolant inlet and coolant outlet for separating vaporized coolant from liquid coolant, condenser means coupled to said separation tank for condensing vaporized coolant flowing from said separation tank to said condenser means during operation of said engine, sump means coupled to said condenser means for receiving condensed coolant from said condenser means, said sump means being coupled to said separation tank for returning liquid coolant to said separation tank and to said engine, and vent means for venting non-condensible gases from said cooling system during operation of said engine, the improvement comprising said condenser means including means adapted to flow ambient air in heat exchange relation with said condenser means, and means, coupled to said air flow means and responsive to the presence of vaporized coolant at a selected location in said condenser means, for actuating said air flow means under high ambient air temperature engine operating conditions, whereby the rate of condensation of vaporized coolant in said condenser means is matched to the rate vaporized coolant is generated by said engine and flows to said condenser means and the flow of vaporized coolant from said condenser means into said sump means is prevented during operation of said engine, and a virtually constant predetermined pressure and predetermined temperature are maintained in said cooling system under all engine operating conditions.

2. The improvement recited in claim 1, wherein said condenser means further comprises means for reducing the pressure and permitting the expansion of vaporized coolant as said coolant flows into said condenser means from said separation tank.

3. The improvement recited in claim 2, wherein said condenser means is coupled to said separation tank by conduit means, and further comprises tube means in said condenser means, said tube means having a diameter which is greater than that of said conduit means.

4. The improvement recited in claim 3, wherein the ratio of the diameter of said tube means to the diameter of said conduit means is at least 2:1.

5. The improvement recited in claim 2, wherein said condenser means comprises a chamber into which vaporized coolant from said separation tank flows, said chamber being dimensioned so as to cause the vaporized coolant to immediately expand as it enters said chamber of said condenser means, thereby reducing the velocity and pressure of said vaporized coolant within said chamber of said condenser means.

6. The improvement recited in claim 5, further comprising elongated air-flow tubes extending through said chamber of said condenser means.

7. The improvement recited in claim 1, wherein said vent means comprises an expansion tank into which non-condensible gases are vented from said cooling system during operation of said engine, said cooling system being closed to the atmosphere.

8. The improvement recited in claim 1, wherein said vent means comprises valve means, said valve means being communicative with the atmosphere for venting non-condensible gases from said cooling system to the atmosphere during operation of said engine.

9. The improvement recited in claim 1, further comprising means, coupled to said separation tank, for heating the oil of said engine during operation thereof, said heating means including conduit means coupled to said engine and through which oil flows during operation of said engine, said conduit means being disposed in said separation tank so as to be at least partially submerged in hot, liquid coolant contained therein, thereby rapidly raising and maintaining the temperature of said oil at a predetermined engine operating temperature.

10. In a boiling liquid cooling system for an internal combustion engine including a coolant inlet and a coolant outlet, said cooling system including a separation tank coupled to said coolant inlet and coolant outlet for separating vaporized coolant from liquid coolant, condenser means coupled to said separation tank for condensing vaporized coolant flowing from said separation tank to said condenser means during operation of said engine, sump means coupled to said condenser means for receiving condensed coolant from said condenser means, said sump means being coupled to said separation tank for returning liquid coolant to said separation tank and to said engine, and vent means for venting non-condensible gases from said cooling system to the atmosphere during operation of said engine, the improvement comprising said vent means being coupled to said sump means and said condenser means including fan means disposed adjacent said condenser means for drawing ambient air over said condenser means, and means, coupled to said fan means and responsive to the presence of vaporized coolant at a selected location in said condenser means, for actuating said fan means during high ambient air temperature engine operating conditions, said cooling system further comprising means coupled to said sump means and the separation tank for preventing the flow of vaporized coolant from said separation tank to said sump means during engine operating conditions under which there is an absence of coolant flow from said sump means to said separation tank, whereby the flow of vaporized coolant from said cooling system to the atmosphere through said vent means is prevented under all engine operating conditions.

11. The improvement recited in claim 10, wherein said fan actuating means comprises temperature sensing means responsive to the temperature of vaporized coolant at said selected location in said condenser means.

12. The improvement recited in claim 11, wherein said means for preventing the flow of vaporized coolant from said condenser means into said sump means further comprises flow restrictor means coupled to said condenser means for restricting the flow of coolant condensed by said condenser means from said condenser means into said sump means, said flow restrictor means causing the formation of a liquid coolant seal at the outlet of said condenser means for preventing the flow of vaporized coolant from said condenser means into said sump means.

13. The improvement recited in claim 10, wherein said fan actuating means comprises pressure sensing means responsive to the pressure of vaporized coolant at said selected location in said condenser means.

14. The improvement recited in claim 10, wherein said means for preventing the flow of vaporized coolant from said separation tank to said sump means comprises non-return valve means.

15. In a boiling liquid cooling system for an internal combustion engine having a cylinder block with at least one cylinder and a cylinder head, at least one inlet for coolant located in the lower part of the cylinder block and at least one outlet for coolant located in the upper part of the cylinder head, the coolant system including a separation tank having a liquid coolant outlet in the lower part of the tank connected to the coolant inlet of the cylinder block, a vaporized coolant inlet connected to the coolant outlet of the cylinder head, a vapor outlet in the upper part of the tank, and a condensate inlet; a condenser having a vapor inlet in the upper part and a condensate outlet in the lower part; a condensate receiving sump having an inlet connected to the condensate outlet of the condenser; a vent connecting the system to the atmosphere; a condensate pump having an inlet communicating with the lower part of the receiving sump and an outlet connected to the condensate inlet of the separation tank; and means for driving the condensate pump to deliver condensed liquid coolant from the receiving sump to the separation tank, the improvement comprising:

a temperature sensor positioned at a selected location between the vapor inlet and the condensate outlet of the condenser, a fan positioned adjacent to the condenser, and means for driving the fan to flow ambient air in heat exchange relation with the condenser whenever the temperature in the condenser exceeds a predetermined value so that the fan operates whenever vaporized coolant is present at the selected temperature sensor location, said vent being connected to the upper part of the receiving sump and the condensate outlet of said condenser having a total flow cross-section for coolant, upstream of the inlet to the condensate receiving sump, which is limited to a predetermined value small enough to cause the formation of a liquid coolant seal before the inlet to the condensate receiving sump, said cooling system further comprising non-return flow means located between the receiving sump and the condensate inlet to the separation tank for preventing the flow of vaporized coolant from the separation tank to the sump in the absence of the flow of liquid coolant from the sump to the separation tank.

16. The improvement recited in claim 15, wherein the condenser is of the type having at least one continuous tube extending from the inlet to the outlet of the condenser.

17. The improvement recited in claim 15, wherein the means for driving the condensate pump is responsive to operation of the engine such that the condensate pump operates whenever the engine is running.

18. The improvement recited in claim 17, wherein the condensate pump comprises a mechanical pump driven by the engine.

19. The improvement recited in claim 8, wherein said mechanical pump is a dual stage fuel/condensate pump.

20. The improvement recited in claim 19, wherein said non-return flow means comprises one-way valve means included in said dual stage fuel/condensate pump.

21. An engine cooling system according to claim 15, wherein the means for driving the condensate pump is responsive to operation of the engine and to operation of the fan such that the condensate pump operates whenever the engine is running.

22. The improvement recited in claim 21, wherein the means for driving the condensate pump is an electric motor, and the system further comprises a source of electric energy, a first switch actuated in response to operation of the engine to connect the electric motor to the source of electric energy, and a second switch connected in parallel with the first switch and actuated in response to operation of the driving means for the fan.

23. The improvement recited in claim 15, wherein the vapor inlet to the separation tank comprises a tubular member having a predetermined length located within the separation tank, the tubular member having a plurality of openings in the sidewall thereof for permitting flow of vaporized coolant therethrough from the engine cooling jacket into the separation tank.

24. The improvement recited in claim 23, wherein the total flow area of the plurality of openings in the sidewall of said tubular member is substantially greater than the internal cross-sectional area of said tubular member, whereby the velocity of coolant vapor flowing through said openings is less than its velocity entering the tubular member.

25. The improvement recited in claim 23, wherein there is a first level within the separation tank corresponding to a normal liquid coolant level when the engine is operating and a second level, below the first level, corresponding to the normal liquid coolant level when the engine is cold.

26. The improvement recited in claim 25, wherein said tubular member extends horizontally at a level above the first level, and said plurality of openings are located around the entire circumference of the sidewall of the tubular member.

27. The improvement recited in claim 25, wherein said tubular member extends horizontally at a level below the first level, and said plurality of openings are located only in the lower part of said tubular member.

28. The improvement recited in claim 15, further comprising means connected to said vent for limiting the maximum and minimum pressures in the receiving sump.

29. The improvement recited in claim 28, wherein said pressure limiting means comprises a pressure relief valve set to a predetermined maximum gauge pressure.

30. The improvement recited in claim 29, wherein said pressure limiting means comprises a vacuum relief valve set to a predetermined negative gauge pressure.

31. The improvement recited in claim 15, wherein the inlet for coolant located in the lower part of the engine cooling jacket includes a U-trap for preventing escape of vaporized coolant from the cylinder block through the coolant inlet.

32. The improvement recited in claim 15, wherein the at least one outlet for coolant located in the upper part of the cylinder head comprises a plurality of outlets adjacent respectively to each cylinder and a manifold connected to said plurality of outlets.

33. The improvement recited in claim 15, further comprising a plurality of heat exchange tubes extending transversely through the separation tank, said tubes having adjacent inlet ends and outlet ends, and means for directing a flow of ambient air into the inlet ends of said heat exchange tubes to provide a flow of warmed air from the outlet ends of said tubes.

34. The improvement recited in claim 15, further comprising means for circulating coolant in a direct path outside the engine between the lower part of the cylinder block and the upper part of said cylinder head during at least the warm up period of the engine, without significant heat loss from the circulated coolant.

35. The improvement recited in claim 15, further comprising means for circulating coolant from one of said at least one outlet for coolant in the upper part of the cylinder head directly to one of said at least one inlet for coolant in the lower part of the cylinder block without significant heat loss.

36. The improvement recited in claim 35, wherein said circulating means comprises a pump having a suction side connected to said one outlet for coolant in the upper part of the cylinder head and a discharge side connected to said one inlet for coolant in the lower part of the cylinder block.

37. The improvement recited in claim 36, wherein said circulating pump is driven by the engine.

38. The improvement recited in claim 36, wherein said circulating means further comprises means for driving said pump only during the warm up period of the engine.

39. The improvement recited in claim 35, wherein said means for driving the pump comprises an electric motor, a thermal switch and a start switch in series for connecting said motor to a source of electric power, and means for actuating said thermal switch to close when the temperature of the coolant in the lower part of the cylinder block is below a predetermined value.

* * * * *